US007475627B2

(12) United States Patent
Irick et al.

(10) Patent No.: US 7,475,627 B2
(45) Date of Patent: Jan. 13, 2009

(54) ROTARY TO RECIPROCAL POWER TRANSFER DEVICE

(75) Inventors: David Kim Irick, Heiskell, TN (US); William Parker Ragain, Knoxville, TN (US)

(73) Assignee: Ragain Air Compressors, Inc., Knoxville, TN (US)

( * ) Notice: Subject to any disclaimer, the term of this patent is extended or adjusted under 35 U.S.C. 154(b) by 610 days.

(21) Appl. No.: 11/235,884

(22) Filed: Sep. 27, 2005

(65) Prior Publication Data

US 2007/0068468 A1 Mar. 29, 2007

(51) Int. Cl.
*F01B 9/04* (2006.01)
*F03C 1/04* (2006.01)

(52) U.S. Cl. ..... 92/138; 417/534

(58) Field of Classification Search ..... 92/72, 92/73, 76, 138; 91/498; 417/62, 534
See application file for complete search history.

(56) References Cited

U.S. PATENT DOCUMENTS

| | | | | |
|---|---|---|---|---|
| 717,445 | A | 12/1902 | Nestius | |
| 871,707 | A | 11/1907 | Koch | |
| 966,622 | A | 8/1910 | Thompson, Jr. | |
| 1,213,917 | A | 1/1917 | Steinhauer et al. | |
| 1,309,257 | A | 7/1919 | Martens | |
| 1,355,451 | A | 10/1920 | Carpenter | |
| 1,445,474 | A | 2/1923 | Benson et al. | |
| 1,594,045 | A | 7/1926 | Caminez | |
| 1,765,237 | A | 6/1930 | King | |
| 1,774,087 | A | 8/1930 | Dunn | |
| 1,792,062 | A | 2/1931 | Barnum | |
| 1,810,688 | A * | 6/1931 | Toce et al. | 123/55.3 |
| 1,830,046 | A | 11/1931 | White | |
| 1,863,877 | A | 6/1932 | Rightenour | |
| 1,931,401 | A | 10/1933 | Baisden | |
| 1,965,548 | A | 7/1934 | Hart | |
| 2,120,657 | A | 6/1938 | Tucker | |
| 2,124,604 | A | 7/1938 | Bidwell | |
| 2,252,153 | A | 8/1941 | Anthony | |
| 2,404,079 | A | 7/1946 | Maniscalco et al. | 230/180 |
| 3,572,209 | A | 3/1971 | Aldridge et al. | |
| 3,584,610 | A | 6/1971 | Porter | 123/55 AA |
| 3,604,402 | A | 9/1971 | Hatz | 123/56 C |
| 3,781,144 | A | 12/1973 | Jacobs | 417/525 |

(Continued)

FOREIGN PATENT DOCUMENTS

GB 2 424 455 A 9/2006

OTHER PUBLICATIONS

International Search Report and Written Opinion of the International Searching Authority, mailed Oct. 26, 2007.

*Primary Examiner*—Thomas E Lazo
(74) *Attorney, Agent, or Firm*—Wood, Herron & Evans, L.L.P.

(57) ABSTRACT

An apparatus to transfer power from rotary power to reciprocating power includes an odd numbered multi-lobed rotating cam that acts on a follower, which, in turn, causes or acts in response to reciprocation of pistons. The follower includes offset head portions and the cylinders, in turn are actually offset in the direction of the head portions. This reduces friction and improves efficiency. Further, the cylinders can include two inlets and two outlets so that each cylinder functions when the piston moves in either direction within the cylinder.

17 Claims, 7 Drawing Sheets

U.S. PATENT DOCUMENTS 4,105,371 A * 8/1978 Savage et al. ..... 417/273
4,331,108 A 5/1982 Collins ..... 123/50 R
4,408,578 A * 10/1983 Konther et al. ..... 92/138
4,414,930 A 11/1983 Hume ..... 123/197 R
4,493,296 A 1/1985 Williams ..... 123/55 AA
4,545,336 A 10/1985 Waide ..... 123/55 AA
4,697,552 A 10/1987 Kolev ..... 123/56 BC
5,431,130 A * 7/1995 Brackett ..... 123/70 R
5,606,938 A * 3/1997 Rowe ..... 123/54.3
5,634,441 A 6/1997 Ragain ..... 123/54.3
5,816,787 A * 10/1998 Brinkerhoff et al. ..... 417/523
5,879,145 A 3/1999 Baumgartner ..... 417/524
5,992,356 A 11/1999 Howell-Smith ..... 123/55.3
6,213,082 B1 4/2001 Ohori ..... 123/197.3
6,394,762 B1 5/2002 Collingborn et al. ..... 417/254
6,742,482 B2 * 6/2004 Artola ..... 123/71 R
6,953,053 B2 10/2005 Waffler et al.
7,328,682 B2 * 2/2008 Fisher ..... 123/197.4

* cited by examiner

ROTARY TO RECIPROCAL POWER TRANSFER DEVICE

BACKGROUND OF THE INVENTION

There are many different devices that are used to transfer rotary motion to reciprocating motion. For example, rotating cam-operated compressors utilize a rotating cam which acts on a follower that forces pistons in and out of a chamber to compress and pump gas. There are also internal combustion engines that include cylinders with pistons which act on a rotating cam to transfer the reciprocating motion of the cylinders to rotary motion.

There is always a drive to improve the efficiency of any power transfer device such as these. The present invention is premised on the realization that the efficiency of such a power transfer device can be improved by offsetting two cylinders from the central axis of the device and utilizing a follower connected to pistons wherein the follower has offsets at both ends. This reduces the friction between the follower and the cam, improving efficiency.

Further, this invention can be utilized in a variety of different devices including pumps, compressors (both liquid and gas), expansion motors/engines, and internal combustion engines. When utilized as a compressor, the present invention can incorporate appropriate seals to allow the compressor pistons to operate without oil.

Further, in certain embodiments, the reciprocating devices utilized can operate in both directions of motion of the piston, increasing output without increasing size.

The objects and advantages of the present invention will be further appreciated in light of the following detailed description and drawings, in which:

DETAILED DESCRIPTION OF THE INVENTION

Figure 1:
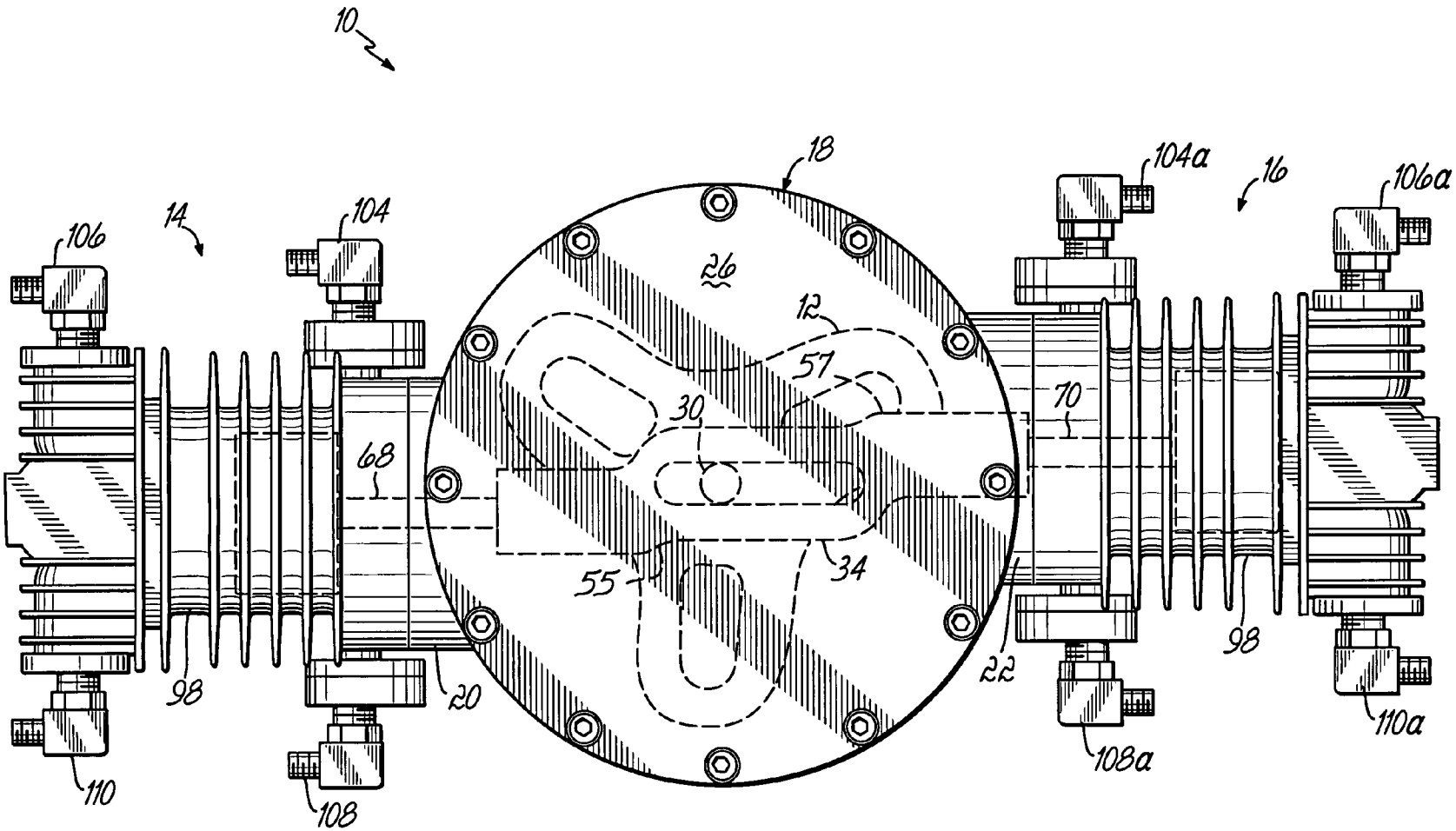
FIG. 1 is an elevational view of one embodiment of the present invention.
Figure 1A:
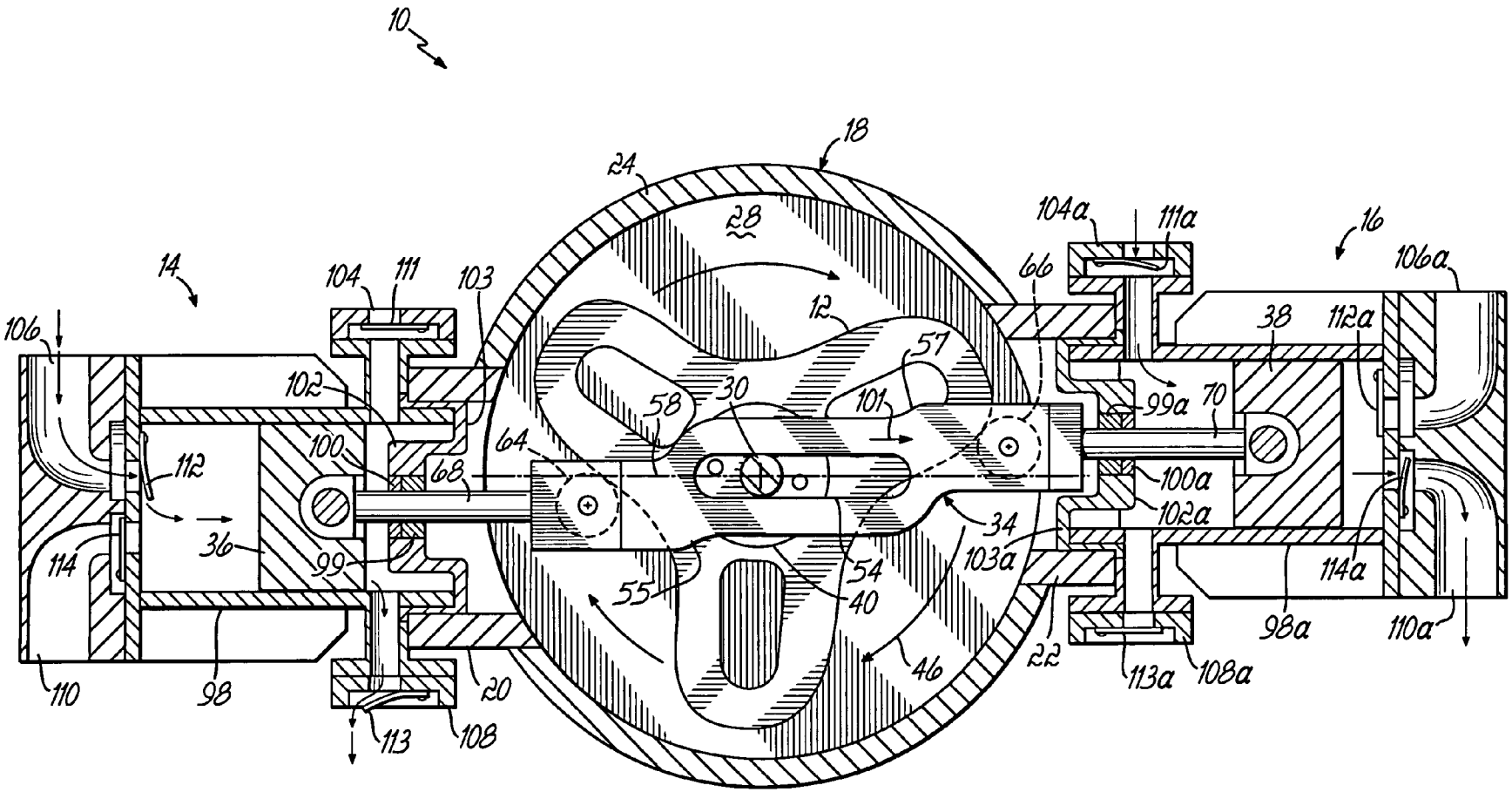
FIG. 1A is an axial cross sectional view of the present invention.
Figure 4:
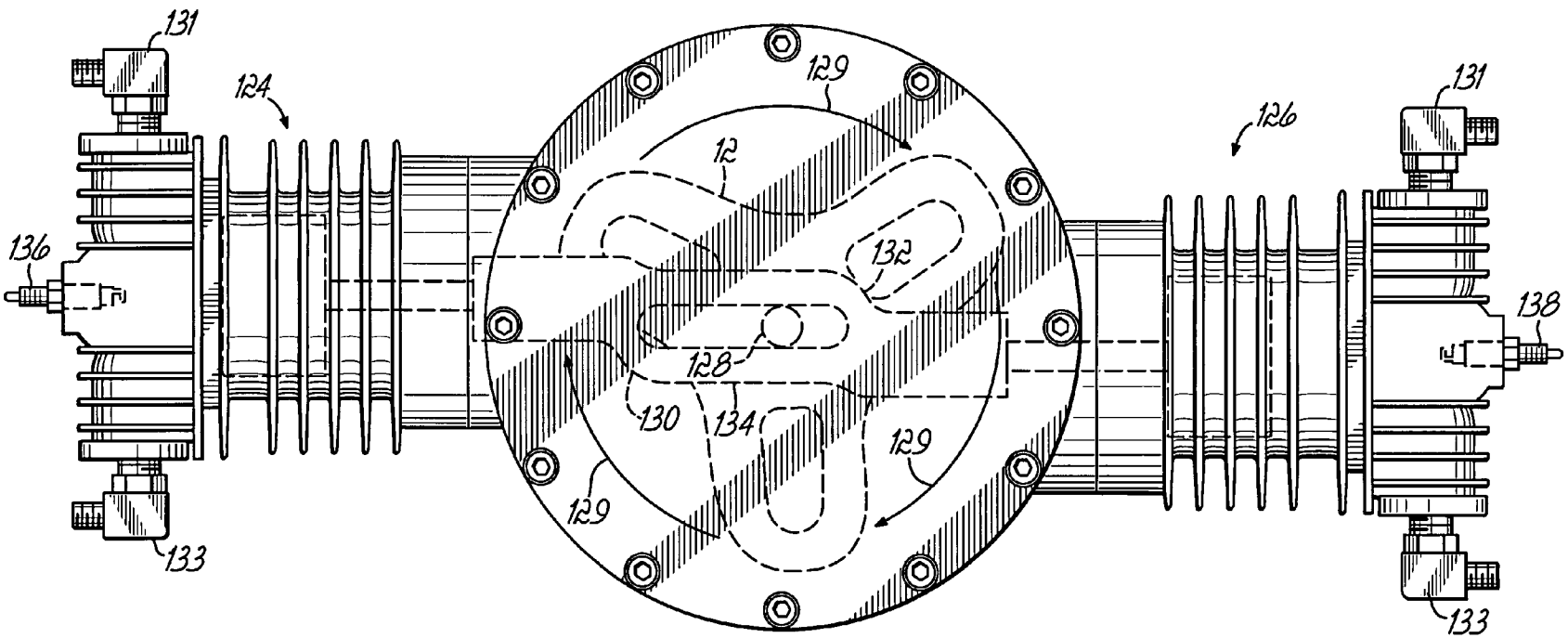
FIG. 4 is an elevational view of an alternative embodiment of the present invention.

As shown in FIGS. 1 and 1A, the present invention is a cam operated power transfer device 10 that is adapted to transfer power between a three-lobed cam 12 and first and second reciprocating devices 14 and 16. The reciprocating devices 14 and 16 can be, for example, internal combustion chambers (as shown in FIG. 4), expansion chambers, pumps, or compressors. Throughout the application, the reciprocating device will be described as a compressor, unless otherwise stated.

The transfer device 10 includes an exterior housing 18. Housing 18 includes a circular peripheral wall 24 and two side walls 26 and 28. First and second cylindrical mounts 20 and 22, located on peripheral wall 24, support the first and second reciprocating devices 14 and 16. A shaft 30 extends through walls 26 and 28 and is fixed to cam 12. The cam 12, when rotated by shaft 30, moves a follower 34 which, in turn, causes a reciprocation of first and second pistons 36 and 38.

More particularly, the shaft 30 includes a disk-shaped flange 40 which is fixed into an annular recess 41 of cam 12. The shaft is supported by first and second bearings 42 and 44 on walls 26 and 28. As shown, cam 12 is designed to rotate in the direction of arrows 46.

Cam 12 is shown with three lobes. But, it can have more than three lobes, as long as there are an odd number of lobes, i.e., five or seven, etc. Three lobes are preferred. Cam 12 rotates within the follower 34 which includes a body portion 48 (see FIG. 3) formed from first and second spaced body members 50 and 52 on either side of cam 12. The first and second members 50 and 52 each include axial aligned slots 54, 56 aligned with a central axis 58 of device 10. The follower 34 has dogleg portions 55 and 57, which are oppositely offset from central axis 58. The follower 34 further includes first and second head portions 60 and 62 which hold the body members 50 and 52 together. First and second rollers 64 and 66 are mounted to head portions 60 and 62. Also fixed to head portions 60 and 62 are first and second rods 68 and 70 which, in turn, attach to the first and second pistons 36 and 38, respectively.

The dogleg portions 55 and 57 and follower 34 are directed toward the driving surface of the cam 12, and opposite the direction of arrows 46. If the device was intended to rotate in an opposite direction, the offsets or doglegs would be in the opposite direction.

If the device is an internal combustion engine, the offset should be in the opposite direction of the intended cam movement, as shown in FIG. 4. Again, this will reduce friction and improve efficiency.

Head portion 60 is resiliently mounted to the first and second members 50 and 52 of the follower body, whereas head portion 62 is fixedly attached to first and second members 50 and 52.

Figure 2:
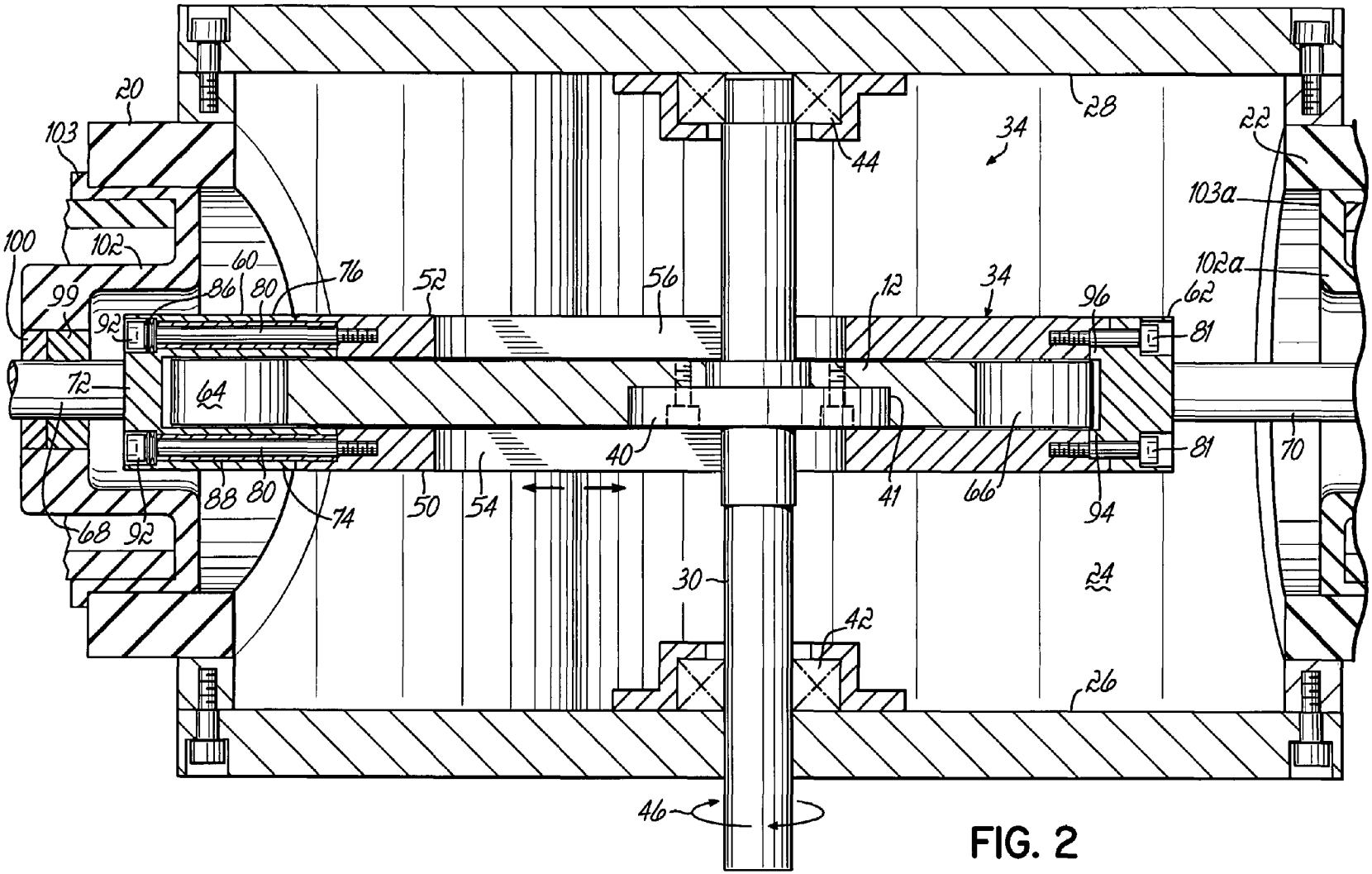
FIG. 2 is a cross sectional view broken away at lines 2:2 of FIG. 1B.
Figure 2A:
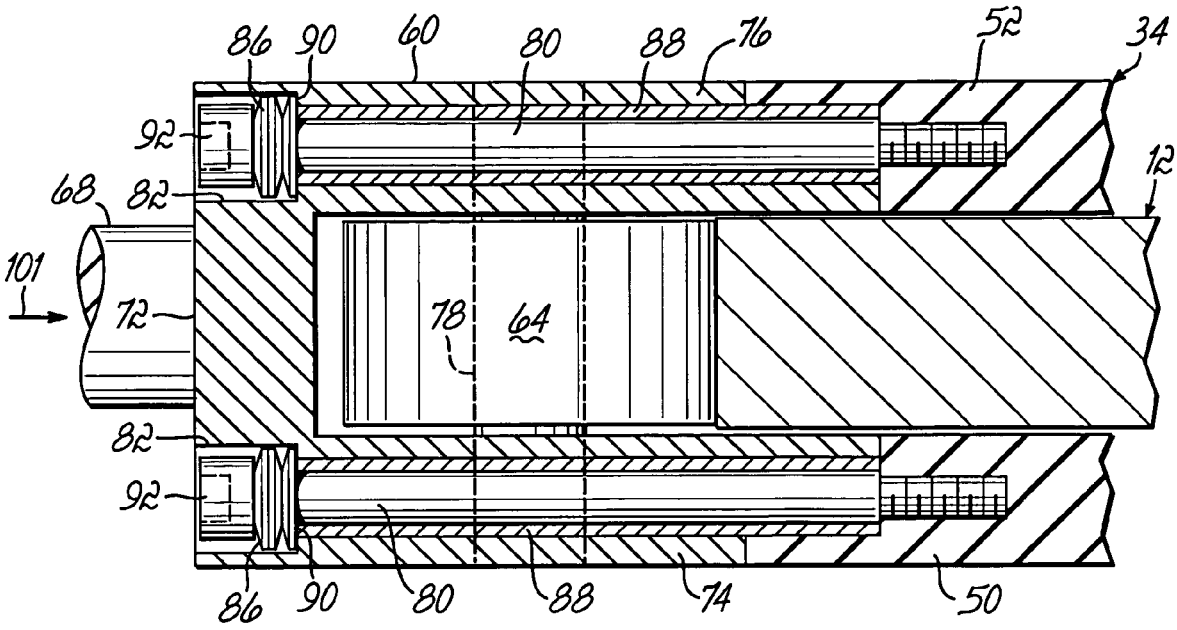
FIG. 2A is an enlarged portion of FIG. 2 with the cam in the position shown in FIG. 1A.
Figure 2B:
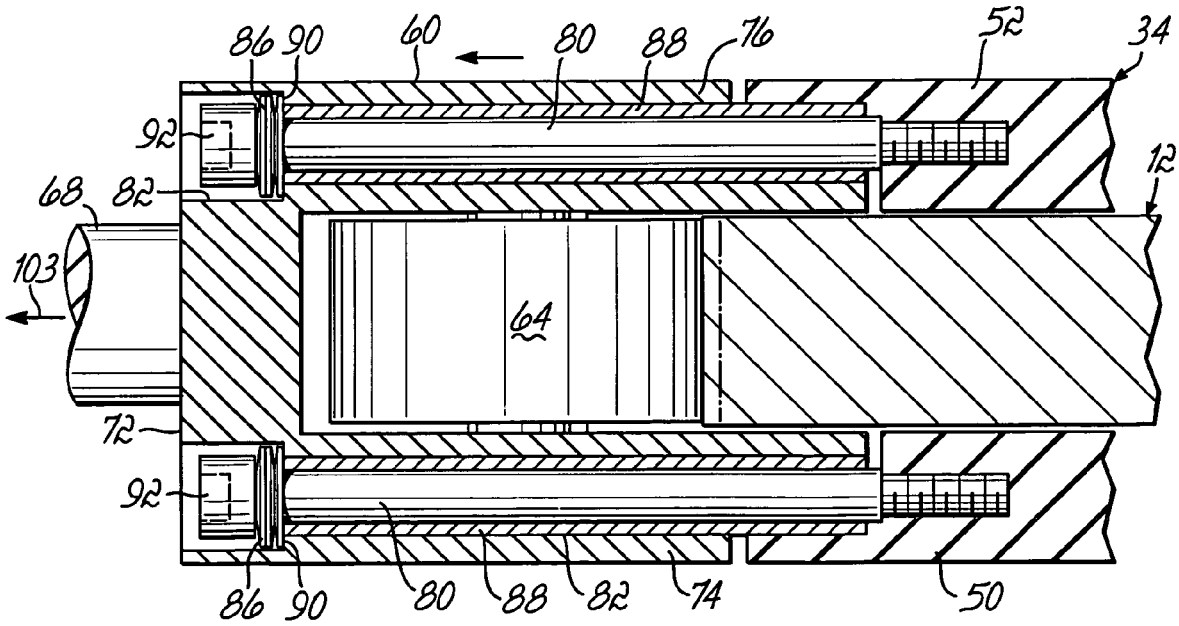
FIG. 2B is an enlarged portion of FIG. 2A with the cam in the position shown in FIG. 1B.
Figure 3:
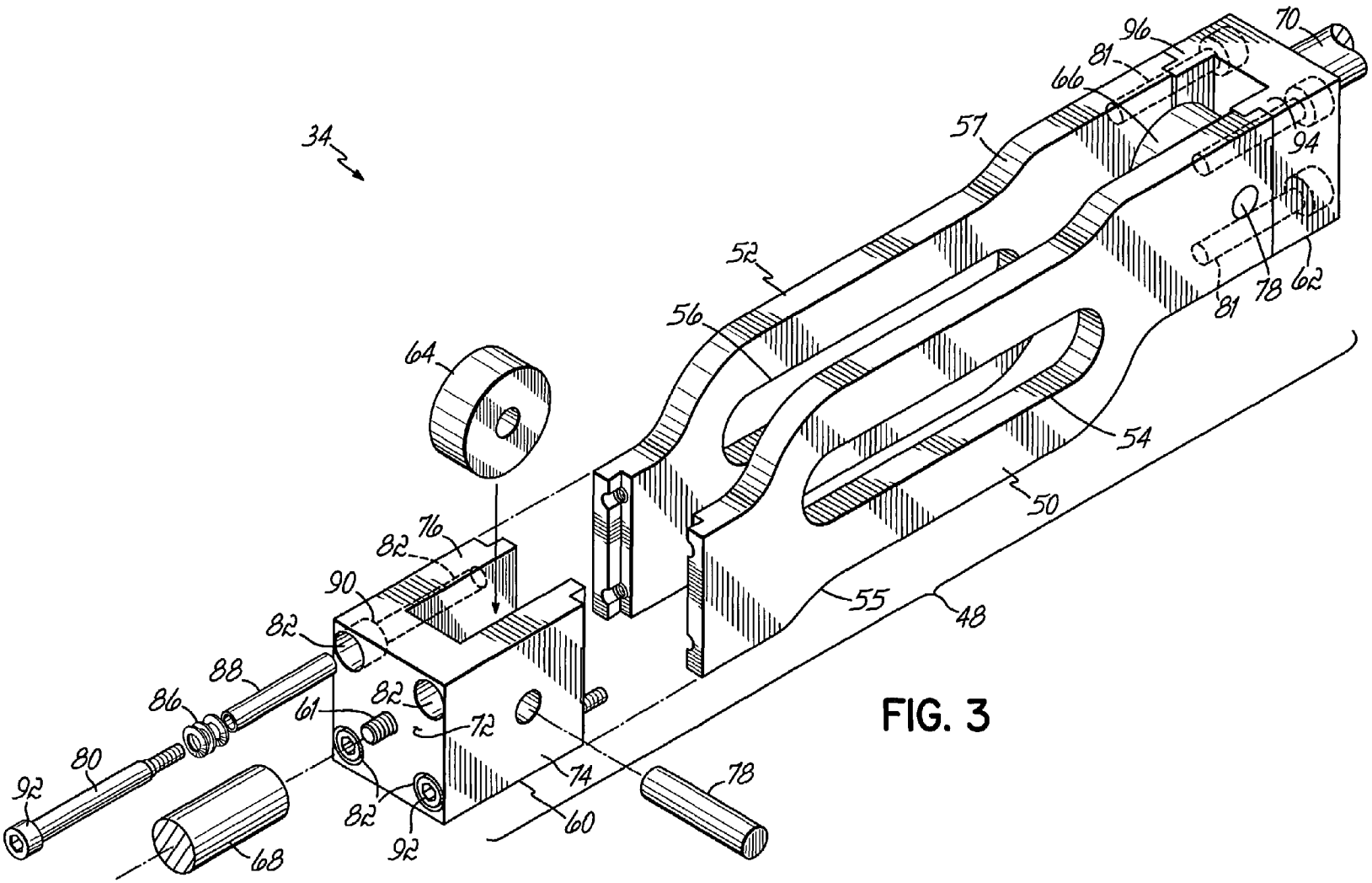
FIG. 3 is an exploded perspective view of the follower of the present invention, partially broken away.

As shown more particularly in FIGS. 3, 2A and 2B, the first head portion 60 includes a top surface 72 and first and second legs 74 and 76. The first roller 64 is attached to the first head 60 by a pin 78 which extends through first and second legs 74 and 76. The head portion 60 is mounted to first and second members 50 and 52 with four hex screws 80 which run through axially stepped bores 82. The shaft 84 of screws 80 extend through a resilient member which is a series of Belleville washers 86 and a sleeve 88 and fastens to members 50 and 52 of the follower body 48. The Belleville washers rest on a shoulder 90 secured by head 92 of screw 80. Any suitable resilient member, such as a spring or the like, can be used in place of the Belleville washer. Further, this resilient member can be located anywhere along the reciprocating member.

The second head 62 can be a mirror image of first head 60, or, as shown, is simply a C-shaped cap with legs 94 and 96 attached with screws 81 to the members 50 and 52 of follower body 48. The rods 68 and 70 are bolted to heads 60 and 62 at one end 61 and are attached to cylinders 36 and 38 at the opposite end, as best shown in FIGS. 1A, 1B, 2 and 3.

Both reciprocating devices 14 and 16 are mirror images of each other. A compressor is described as the reciprocating device, although this could be a pump or an internal combustion cylinder. Compressors 14 and 16 include cylindrical chambers 98, 98*a* which house pistons 36 and 38. Rods 68 and 70 extend into chambers 98, 98*a* through bushings 99, 99*a* and oil seals 100, 100*a* or in circular plates 102, 102*a* of discs 103, 103*a*. Cylindrical chambers 98, 98*a* fits within discs 103, 103*a* forming sealed cylindrical chambers.

Reciprocating devices 14 and 16 include inner and outer intakes 104, 104*a* and 106, 106*a* and inner and outer exhausts 108, 108*a* and 110, 110*a*. Each of these utilizes flap valves 111-114, 111*a*-114*a* to allow air or gas in or out of the chamber.

In operation as a compressor, the shaft 30 will rotate, causing the cam 12 to rotate. This, in turn, will act upon rollers 64 and 66. As roller 64 is pushed outwardly, the heads 92 of screws 80 compress the Belleville washers, creating gaps between legs 74 and 76 and first and second members 50 and 52, as shown in FIGS. 2A and 2B.

Figure 1B:
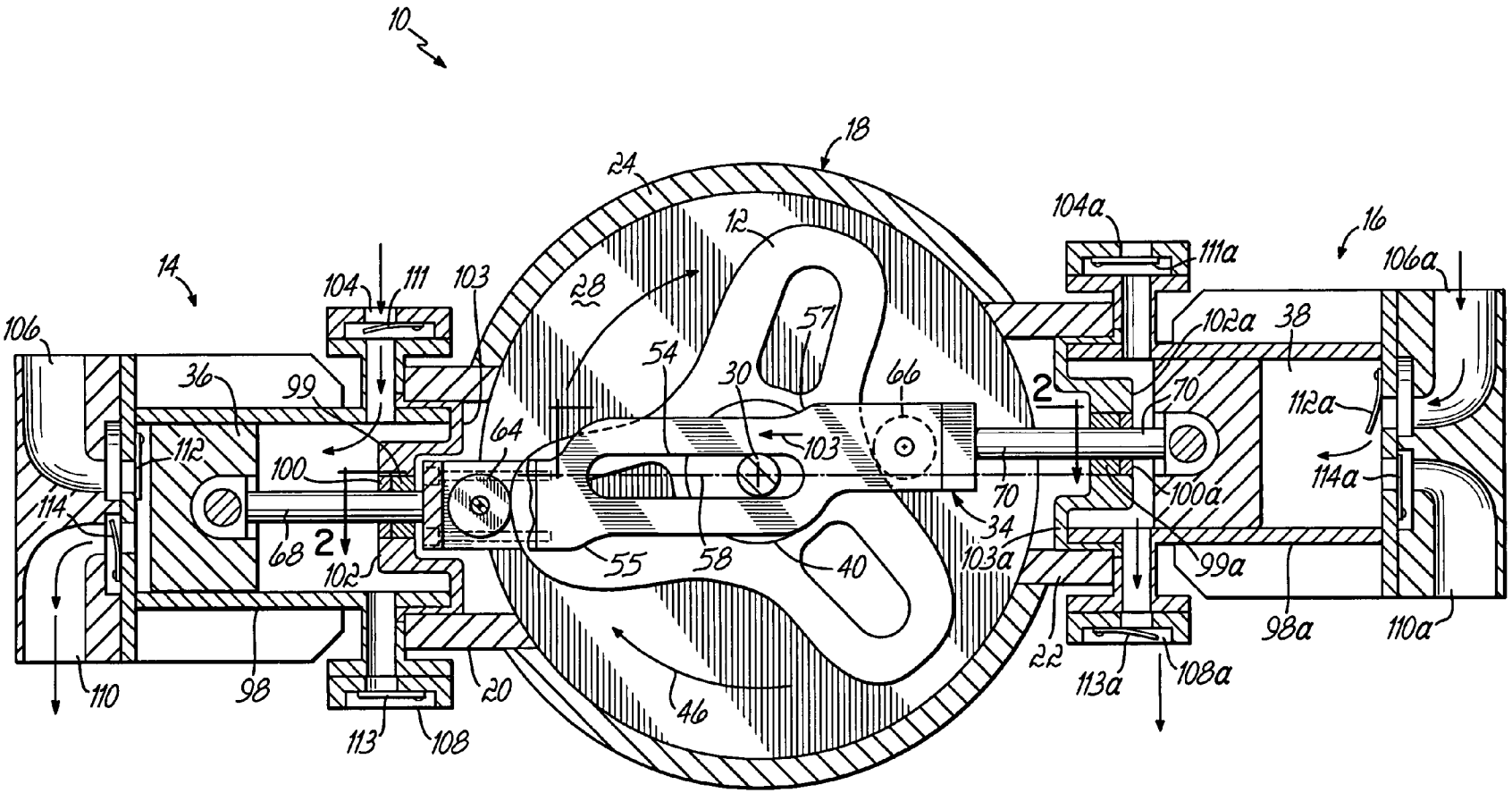
FIG. 1B is an axial cross sectional view of the present invention wherein the cam is rotated approximately 90 degrees relative to FIG. 1A.

The action of the cam 12 against rollers 64 and 66 causes the follower 24 to move in the direction of arrow 101, as shown in FIG. 1A, and, subsequently in the direction of arrow 103 in FIG.1B. This will, in turn, cause the rods 68 and 70 and associated cylinders 36 and 38 to move in the direction of arrow 101 and, subsequently, arrow 103.

Because the compressors are set up for operation in either direction of cylinder movement, both pistons 36 and 38 will be compressing gas regardless of the direction of movement of the pistons 36 and 38.

As piston 36 moves in the direction of arrow 101, it will force gas through exhaust 108. At the same time it will draw gas in through inlet 106. While piston 38 moves in the direction of arrow 101, piston 38 will force gas through outlet 110*a* and draw gas in through inlet 104*a*.

When the follower 34 moves in the opposite or return direction, this is all reversed with air being drawn in through intake 104 and forced out through outlet 110 of cylinder 98 and in through intake 104*a* and out exhaust 113*a*. Thus, both pistons 36 and 38 are compressing gas regardless of the direction of movement. This significantly increases output without increasing the overall size of the compressor apparatus.

In this embodiment, the oil seals 100, 100*a* separate the housing 18 and the cylinders 98, 98*a*, preventing oil in the housing 18 from entering the cylinders 98, 98*a*. This allows the compressor cylinders 98, 98*a* to operate without oil. Thus, in applications where the presence of oil cannot be tolerated, this eliminates the need for any type of oil removal equipment downstream from the compressor.

FIG. 4 shows a diagrammatic depiction of the present invention incorporating internal combustion chambers or cylinders 124 and 126. Each cylinder will include gas intake 131 and exhaust 133, and spark plugs 136, 138. In this embodiment, the reciprocating devices are providing force to the rotating shaft 128 in the direction of arrow 129.

Accordingly, the doglegs 130 and 132 of the follower 134 go toward the direction of rotation. Again, this reduces friction and improves efficiency. As shown in FIG. 4, the cylinders produce force only when the pistons are moving inwardly toward shaft 128. Spark plugs 136 and 138 are only located at outer ends of cylinders 124 and 126. A second set of spark plugs, as well as additional intake and exhaust valves and fuel inlets can be positioned at the inner portion of cylinders 130 and 132 to generate force in both directions of piston movement, if desired.

With any type of reciprocating to rotary motion transfer device, the offset follower will act to reduce friction and improve efficiency. This applies to transferring motion from reciprocating to rotational movement as in an internal combustion engine or even a steam engine and a rotary to reciprocating device such as a pump or compressor.

Likewise, each reciprocating device can function in one or both directions of piston movement. Operating in both directions increases output with the same size equipment.

This has been a description of the present invention along with the preferred method of practicing the present invention. However, the invention itself should only be defined by the appended claims, WHEREIN

We claim:

1. A power transfer mechanism between a rotating element and first and second reciprocating devices comprising a multi-lobed rotating cam rotatable with a shaft;

a follower having two bearing surfaces riding on said cam, said follower movable back and forth along a first axis;

said follower having first and second ends fixed to first and second pistons in said first and second devices, said first and second ends being oppositely offset from said first axis wherein said pistons are movable on second and third axes which are offset and parallel to said first axis.

2. The apparatus claimed in claim 1 wherein said follower includes a central body portion with first and second oppositely extended doglegs.

3. The apparatus claimed in claim 1 wherein said cam is a three-lobed cam.

4. The apparatus claimed in claim 1 wherein said reciprocating devices are compressors, said compressors having first and second chambers separated by said piston with first air inlets into said first chambers and first air outlets from said first chambers, and second air inlets into said second chambers and second air outlets from said second chambers.

5. The apparatus claimed in claim 1 wherein said reciprocating devices are internal combustion chambers.

6. The apparatus claimed in claim 1 wherein said follower comprises two mirror image members each having an elongated slot along said first axis;

first and second rollers adapted to contact said cam;

first and second head members each fixed to said first and second body members at opposite ends thereof wherein said head members are fixed to said pistons.

7. The apparatus claimed in claim 6 wherein one of said first head members is resiliently attached to said follower body members.

8. The apparatus claimed in claim 7 wherein said head member attaches to said first and second body members with fasteners, said fasteners each having a head;

a compression member between said heads of said fasteners and said first head member whereby compression of said compression member provides resilience between said first head member and said follower.

9. The apparatus claimed in claim 1 wherein said reciprocating devices are expansion chambers with first fluid inlets into said first chamber and first fluid outlets from said first chamber and second fluid inlets into said second chamber and second fluid outlets from said second chamber.

10. The apparatus claimed in claim 1 wherein said reciprocating devices are expansion chambers and said device is an expansion motor.

11. The apparatus claimed in claim 5 wherein said first and second pistons move in chambers and divide said chamber into inner and outer chambers and wherein said inner and outer chambers each include gas inlets and gas outlets, and fuel inlets.

12. A power transfer device for transferring power between a rotating cam and first and second reciprocating devices, said first and second reciprocating devices each having a chamber and a piston adapted to move in first and second directions within said chamber, said piston dividing said chamber into inner and outer chambers, first and second gas inlets are provided into said inner and outer chambers first and second gas outlets are provided from said inner and outer chambers, and further comprising a multi-lobed rotating cam and a follower, said follower having two bearing surfaces riding on said cam and moving back and forth along a first axis, said follower having first and second ends attached to said pistons, said first and second ends being offset from said axis wherein said pistons move along second and third axes which are parallel to said first axis.

13. The power transfer device claimed in claim 12 wherein first and second reciprocating devices are compressors whereby said pistons compress gas when moving in both first and second directions.

14. A power transfer device comprising:

a rotating multi-lobed cam in a main housing;

lubricant in said main housing;

a follower associated with said cam and first and second rods extending from said follower extending through said housing and connected to pistons, said follower having two bearing surfaces riding on said cam and moving back and forth along a first axis, said follower having first and second ends attached to said pistons, said first and second ends being offset from said axis wherein said pistons move along second and third axes which are parallel to said first axis;

said pistons positioned in cylinders fixed to said housing;

lubricant seals between said housing and said cylinders wherein said rods extend through said seals thereby permitting oil-less operation of said cylinders with positive lubrication of said cam and follower.

15. The device claimed in claim 14 wherein said cylinders are compressors.

16. The device claimed in claim 14 wherein said cylinders are expansion chambers.

17. The device claimed in claim 14 wherein said cylinders are pumps.

* * * * *